United States Patent [19]

Moisan

[11] Patent Number: 4,838,521

[45] Date of Patent: Jun. 13, 1989

[54] APPARATUS FOR MANIPULATING MANHOLE COVERS

[76] Inventor: Gerald L. Moisan, 12555 N. 75th St., Longmont, Colo. 80501

[21] Appl. No.: 197,930

[22] Filed: May 24, 1988

[51] Int. Cl.[4] ..... B66F 11/00

[52] U.S. Cl. ..... 254/131; 414/684.3

[58] Field of Search ..... 254/131, 120; 294/15, 294/17, 18, 8 R; 414/684.3; 212/166

[56] References Cited

U.S. PATENT DOCUMENTS

| | | | |
|---|---|---|---|
| 3,985,338 | 10/1976 | Heumann | 254/131 |
| 4,076,217 | 2/1978 | Haller et al. | 254/131 |
| 4,126,297 | 11/1978 | Barnes | 254/131 |
| 4,482,182 | 11/1984 | Mortensen | 254/131 |
| 4,662,607 | 5/1987 | Mochizuki et al. | 254/131 |

*Primary Examiner*—Robert C. Watson

*Attorney, Agent, or Firm*—Earl C. Hancock; Francis A. Sirr

[57] ABSTRACT

A lifting tool for heavy, flat, round covers, such as manhole covers, is disclosed. The covers include two pairs of diametrically opposed edge notches. The lifting tool comprises an upright column, the lower end of which terminates in a first pair of prongs or teeth that are adapted to cooperate with one of the notch pairs. A swing arm is pivotally connected to an intermediate portion of the tool's upright column. The swing arm includes one or more sets of teeth to facilitate lifting of covers having different diameters. The swing arm teeth are adapted to cooperate with the second pair of cover notches, to thereby facilitate lifting of the cover out of its casing by manual rotation of the upright column about the first pair of teeth. The upright column includes wheels that are located above the first set of teeth. These wheels are located so that they will not engage the ground until the cover has been lifted out of its casing, thus facilitating movement of a lifted cover. The tool can include a pin adapted to cooperate with a lifting hole that is provided in some, but not all, covers.

11 Claims, 2 Drawing Sheets

APPARATUS FOR MANIPULATING MANHOLE COVERS

TECHNICAL FIELD

The present invention relates to tools and means for lifting, handling and manipulating heavy flat plates. More particularly, this invention relates to apparatus and methods for lifting heavy flat plates, and thereafter maneuvering such plates from one location to another. The invention is useful for lifting, removing, relocating, and replacing disk shaped objects and/or large and heavy grates. While not limited thereto, this invention is especially well suited for performing these functions in a safe and convenient manner on manhole covers, siuch as are used to cover the openings of casing access holes, which casings contain elements associated with telephone or power system utilities.

BACKGROUND

Lifting and moving large flat plates, such as manhole covers, is not only physically difficult, but also hazards the risk of injury to those involved. A typical manhole cover is anywhere from two to three feet in diameter, is about one inch thick, and more importantly, weighs in the range of 180 to 360 pounds. Their awkward size and weight has caused many a serious injury when only a pinch or pry bar is used to initiate lifting, with the final cover removal being produced by manual labor. An example of an improved pry bar intended to ease the initial lifting is shown in U.S. Pat. No. 3,837,622 by Gale.

A variety of configurations have received attention over the years to simplify plate handling. Some require special adaptation of the cover to match the tool, such as the threaded engagement devices of U.S. Pat. No. 3,198,362 by Berg, U.S. Pat. No. 4,157,810 by Haller et al, and U.S. Pat. No. 4,365,925 by Girtz. Such devices are useless for covers not modified to mate the engaging structure. In addition, dirt and debris from normal usage of the covers impedes use of the device, even if the cover is suitably modified.

Others have suggested use of L-shaped arms for insertion into holes in the covers, which arms are then forced or pivoted under the lower surface of the plate for lifting. Examples are shown in U.S. Pat. No. 4,126,297 by Barnes, U.S. Pat. No. 4,488,706 by Kono, U.S. Pat. No. 4,653,728 by Mochizuki et al and U.S. Pat. No. 4,662,607 by Mochizuki et al. The necessarily small size of the transverse lip of the L-shaped member, along with hazards resulting from wear of that lip during use, seriously discount these devices as adequate solutions. In addition, they too suffer from problems of debris plugging the holes and, of course, are useless for covers that have no holes. U.S. Pat. No. 3,275,299 by Meshew, although another version of the L-shaped arm approach, additionally suggests configuring a lower ground engaging cam surface to aid in raising the cover after it is engaged.

Another device for engaging manholes which have circumferential notches is shown in U.S. Pat. No. 4,482,182 by Mortensen, which device has hooks on the ends of both a parallel beam assembly and a handle that are interconnected by a sliding bar. The hooks are inserted into the edge notches and the handle is moved until a latch sets, securing the parallel beams and handle in place so that the user can lift the plate. Other than providing a convenient handle to lift the cover, Mortensen does not suggest any means for safely manipulating the cover once it is lifted.

Several arrangements of tools suitable for safely moving large flat plates and grates, using an approach wherein the plate is securely gripped at or near one edge of the plate, are disclosed in my co-pending patent application Ser. No. 07/156,380 filed Feb. 16, 1988 and entitled Maneuvering Device for Heavy Flat Plates.

DISCLOSURE OF THE INVENTION

The present invention is a relatively simple device for safely gripping opposite edges of large, heavy plates to allow relatively easy lifting and maneuvering of such plates. This result is achieved with significant reduction of risk of physical injury to the users, either from physical strains which frequently causes back injuries and/or from loss of control of the cover once it is removed from the manhole, with an attendant threat of injury to fingers and feet of the user, for instance.

Tools in accordance with this invention are well suited for facilitating the handling of telephone or other utility type manhole covers. Such covers are generally flat and heavy, and provide a relatively narrow edge around the perimeter thereof to ifit into a recessed shoulder at the opening of a casing. The tool has an elongated handle with at least one prong extending from one end, and in the same general direction as the length of the handle. A swing arm has a gripper on one end for engaging the cover edge and, on the other end, has an arrangement for pivotally attaching the swing arm to the handle at a point in proximity to the prong. The swing arm is constructed with a length so that the cover edge engaging gripper enters between the cover edge and the casing on one side of the cover when the prong is inserted into the space between the cover edge and the casing on the opposite side of the cover.

A ground engaging assembly is secured to the handle in a position above the ground when the prong is inserted into the space between the cover edge and the casing. However, the ground engaging assembly subsequently contacts the ground in response to manual rotation of the handle in a direction away from the cover. This manual rotation places the prong and the gripper into engagement with respective sides of the cover, and rotation of the elongated handle, as a lever, and in a direction away from the cover, until the ground engaging assembly contacts the ground, results in removal of the cover from the casing in a secure and controlled manner.

The gripper can include a tooth having a surface for engaging the cover perimeter edge with that tooth surface sloping towards the bottom edge of the cover. By this configuration, the tooth surface maintains contact below the cover's upper surface, in response to the lever rotation of the elongated handle.

For many manhole covers, such as those employed in telephone and power system facilities, it is preferable that the handle have a pair of prongs in spaced relation on the handle for engaging the cover's perimeter edge at seperated contact points. Further, the swing arm may also have a pair of grippers for engaging the cover edge in spaced locations opposite the prongs. The grippers may take the form of teeth having surfaces that are angled at about 70 degrees relative to the length of the swing arm.

The swing arm may attach to the elongated handle in one of two orientations, to facilitate the lifting of covers having different diameters.

The tool has enhanced utility if the ground engaging assembly includes an arrangement for rolling the tool away from the casing opening after rotation of the elongated handle. Controlled manipulation of the removed cover is obtainable if this rolling arrangement includes a wheel and a shaft for concurrently contacting the ground in response to rotation of the elongated handle, so that the lifted cover may be pivoted away from the casing generally around the point of ground engagement by the shaft.

In the perspective of telephone type manhole covers, tools in accordance with this invention are particularly useful in handling a bulky, generally flat cover which has a first pair of notches directed inwardly from its edge on one side, and a second pair of notches directed inwardly from its edge along the side opposite the first pair of notches. The elongated handle has two cover engaging assemblies attached to it. The first cover engaging assembly includes a pair of prongs which are positioned in spaced relation for entry in one pair of the cover notches; the second cover engaging assembly, which is attached to the handle, includes a structure securable to the cover at a location remote from the prongs when the prongs are positioned to engage the cover.

Maneuverability of the tool is achieved by means attached to the handle in a position that is separated from the ground when the cover engaging assemblies initially contact the cover, but which is responsive to rotation of the elongated handle in a direction away from the cover for engaging the ground at two spaced points. As previously mentioned, the ground engaging means can include at least one wheel for establishing rolling capability for the tool with the cover secured thereto. The ground engaging means can include a pin cooperative with the wheel for establishing a generally vertical center of rotation for the tool.

Instead of (or occasionally in addition to) the above mentioned edge notches, some utility type manhole covers have a hole therethrough, which hole is inset from the edge but is in proximity to the edge. For this type of cover, the second engaging assembly can include a rod adapted for insertion into the cover hole, with the above mentioned prongs contacting the cover in spatial relation, for locating the ground engaging means at a location for contacting the ground in the same manner as when the prongs are inserted into one of the pairs of edge notches.

The invention is suitable for advantageous adaptation to include a stub means on one extremity of a generally horizontal frame, so that the stub means engages the ground after the assembly is pivoted, so as to accommodate arcuate movement of the apparatus around a roller wheel that is mounted on the other extremity of the frame. The stub is positionable so that the roller wheel associated with the end of the frame to which the stub is attached engages the ground instead of the stub when the frame is only partially pivoted (e.g.: in its inoperative or storage position).

The use of the stub is particularly attractive when it is necessary to remove a manhole cover or grate at a location where there is a high risk of loss of control of the cover at a time that maintenance of such control is critical, such as on a sloping street or hillside.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
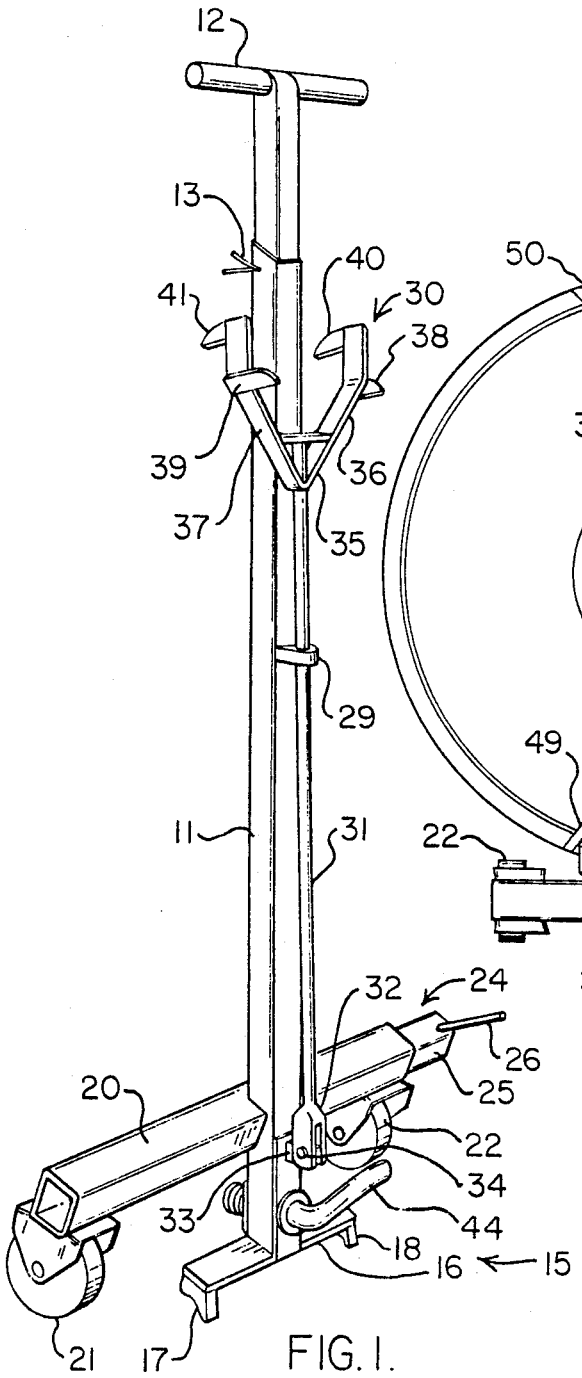
FIG. 1 is an isometric view of an embodiment of the invention, and additionally illustrates the inoperative or storage relationship of a stub member or insert frame with respect to the apparatus.

The plate lifting and maneuvering device 10 of this invention is shown in perspective in FIG. 1. The present invention is particularly well suited for use with contemporary manhole covers, which typically are between two and three feet in diameter, and weigh around 180 to 360 pounds, or more. Tool 10 is especially useful for manipulating covers of the type used by telephone or power utilities that are 29 or 31 inches in diameter and have downwardly sloping pairs of notches on opposite sides of the cover. Sometimes these covers include a hole therethrough, usually located about four inches inwardly from the cover edge, either with or without the inclusion of the aforementioned edge notch pairs on the cover.

An elongated column 11 receives a telescoping T-handle 12 at its upper end for use convenience. Handle 12 is positionable at various extended lengths from the top of column 11, by removing spring clip 13 and sliding handle 12 up or down, so as to align a different set of holes in handle 12, before replacing clip pin 13 into the column and the handle.

Secured to the lower end of column 11 is a prong assembly 15 comprised of a plate 16 having two downwardly extending prongs or teeth 17 and 18. A ground engaging assembly, comprised of box channel 20 and two wheels 21 and 22, is rigidly attached to column 11 at a location just above prong assembly 15. Preferably, the rear surfaces of teeth 17 and 18 include cam configurations as is discussed below.

An auxiliary attachment assembly 24 is also illustrated in FIG. 1 in its inoperative, storage position relative to tool 10. Assembly 24 is composed of a box-like insert frame 25 which fits into the interior of box channel member 20, insert frame 25 having a pin or shaft 26 extending therefrom.

For active use, insert frame member 25 is withdrawn from one end of channel 20, rotated so that its shaft 26 is pointing downwardly and rearwardly, and then reinserted into channel 20.

By having an appropriate amount of extension of frame 25 on both sides of pin 26, assembly 24 is usable on either end of channel 20. For example, it can then fit into the other end of channel 20 from that shown in FIG. 1. In this position as shown, downwardly extending shaft 26 establishes a generally vertical axis of rotation for tool 10, when shaft 26 and wheel 21 both engage the ground in response to rotation of tool 10 so as to lift a cover, as is described below for FIGS. 2, 3 and 4. In this position of shaft 26, the adjacent wheel 22 is held above the ground, as its adjacently located shaft 26 operates as a generally vertical axis of rotation for the tool.

Thus assembly 24 functions substantially the same as a similar assembly shown and described in detail in my co-pending patent applicatin Ser. No. 07/156,380 filed Feb. 16, 1988.

Attached to column 11 is a swing arm assembly 30 having an elongated shaft 31 whose U-shaped member 32, located on one end thereof, is pivotally attached to ear 33 of column 11, by means of pin 34. The other end of shaft 31 has a yoke 35 with two arms 36 and 37 having teeth 38 and 39 extending from one side, and similarly configured teeth 40 and 41 extending therefrom in a direction opposite the direction of teeth 38,39.

As is apparent from the following description, teeth 36 and 37 are located at an appropriate distance along shaft 31 for engaging with one diameter of cover (eg: 29 inches), while teeth 40 and 41 are located for engagement with a slightly larger diameter cover (eg: 31 inches). As shown, shaft 31 is releasably retained in a storage or inoperative position by means such as a hook 29 or the like.

Figure 2:
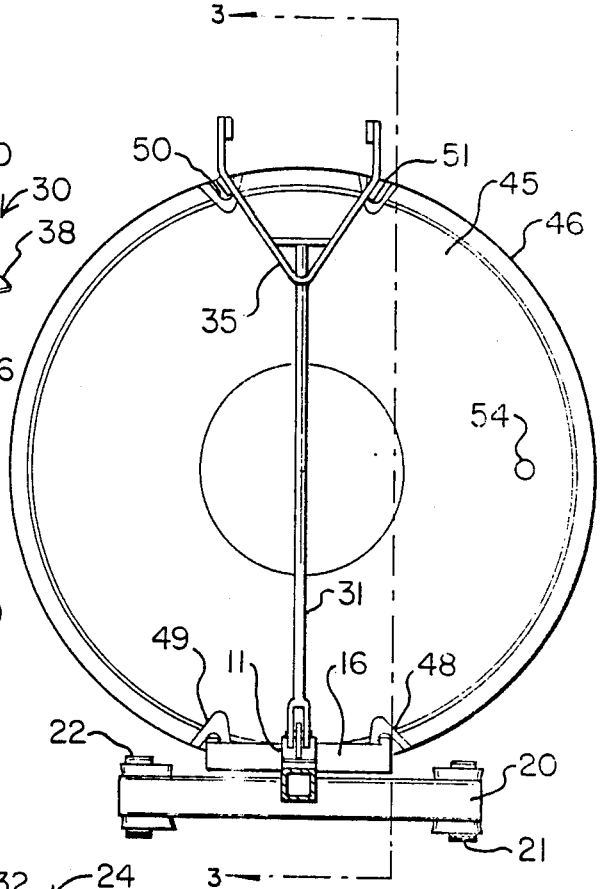
FIG. 2 is a top view of the FIG. 1 apparatus showing it in position to remove a utility type manhole cover.

A telephone or power utility type manhole cover 45 is shown in the top view of FIG. 2, with tool 10 in its operative position. Typical covers 45 have two pairs of edge notches 48,49 and 50,51 located on diametrically opposite sides of the cover.

Figure 3:
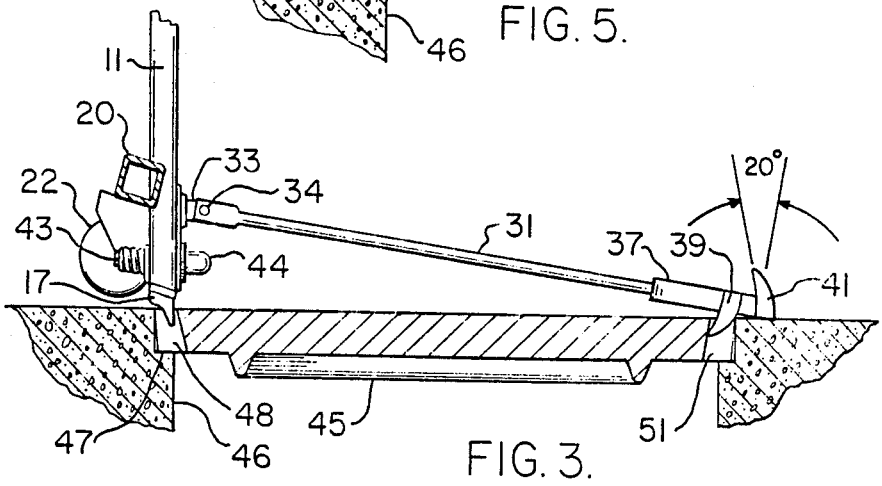
FIG. 3 is a section view of the FIG. 1 apparatus taken along the line 3—3 of FIG. 2.

A section view, taken along the line 3—3 of FIG. 2, is shown in FIG. 3. FIG. 3 illustrates the location of prongs 17 and 18 as they are introduced downwardly into the space between the edge of the sidewall of manhole casing 46, above shoulder 47. FIG. 3 likewise shows how teeth 38 and 39 (or teeth 40 and 41, if these teeth are selected for use) initially enter their respective notches 50 and 51 on the opposite side of cover 45.

FIG. 3 also shows that notches 48,49,50,51 all have an inner edge that is provided with a downwardly and inwardly directed slope.

The front surfaces of teeth 38 and 39 (and teeth 40 and 41) that face toward the edge of cover 45 preferably have a slope of about 70 degrees from the horizontal, so that they point generally inward, to engage the edge of cover 45 within the associated notch, and thus operate to contact the edge below the outer perimeter of the outer, upper surface of cover 45.

Figure 4:
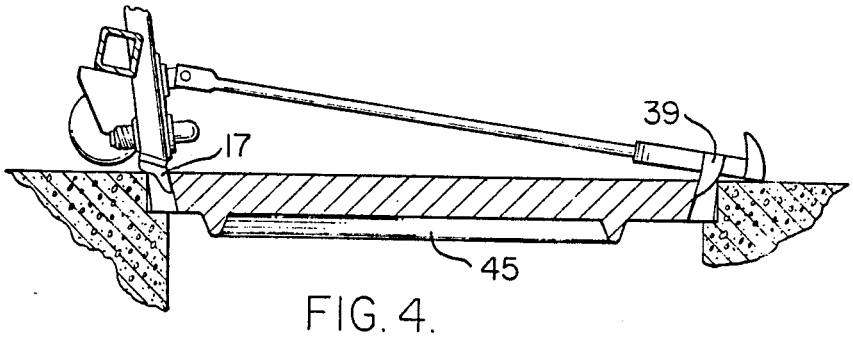
FIG. 4 is a view of the elements of FIG. 3 when the cover is secured in response to rotation of the tool handle.

As handle 12 is rotated backwardly, in a counterclockwise (CCW) direction away from cover 45, as seen in FIG. 3, teeth 17, 18, 38 and 39 securely clamp cover 45 between all four teeth, as is evident in FIG. 4.

Figure 6:
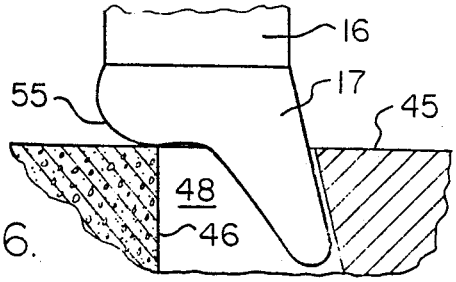
FIG. 6 is a side view illustrating the camming function of the handle teeth.

A feature of the invention is the construction and arrangement of prongs 17,18 that provide a cam surface 55 (see FIGS. 3 and 6) on each of the prongs. This cam surface is configured to engage the surface of the casing during the initial lifting of cover 45. During this initial lifting, the tool rotates about the two cam surfaces 55, and wheels 21,22 do not engage the ground until cover 45 has cleared casing 46. In this way, the two important events of cover lifting and subsequent cover movement, are effected by two separate means, without interference of the operation of one means by the other. Further, the mechanical advantage of the length of the handle is maintained by cam surfaces 55. If wheels 21 and 22 contact the ground before cover 45 is lifted, the fulcrum shifts to the axis of wheels 21 and 22 thus reducing the mechanical advantage.

Figure 5:
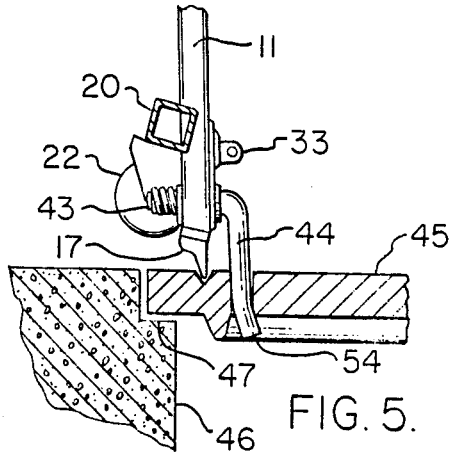
FIG. 5 is a side, partially sectioned view of the FIG. 1 apparatus showing use of the pivotable bar or rod for cover engagement and removal.

As stated previously, instead of cover 45 having edge notches 48,49,50,51, or occasionally in addition to these notches, cover 45 may be provided with a hole 54, as is shown in FIGS. 2 and 5. Tool 10 accommodates such covers by the structure seen in FIGS. 1 and 5 including a second cover engaging assembly in the form of an L-shaped rod 44. The bottom portion of vertical column member 11 includes a hole that pivotally receives the horizontal portion of rod 44. A coiled compression spring 43 surrounds this horizontal portion of rod 44. Spring 43 provides a force between column member 11 and an enlarged head of rod 44. This construction provides for an inoperative storage position for rod 44, as is seen in FIG. 1, or an operative position for rod 44, as is seen in FIG. 5.

As seen in FIG. 5, when rod 44 is in its operative position, rod 44 may be inserted into the cover hole 54. With tool 10 in this position, prongs 17 and 18 engage the top surface of cover 45 at two locations that are spaced from hole 54. As tool 10 is now manually rotated (CCW as seen in FIG. 5), cover 45 pivots about its engagement with shoulder 47. Cover 45 is thereby lifted until a point is reached where wheels 21,22 (or perhaps one of these wheels and pin 26, if the pin is selected for use) engage the ground surface adjacent casing 46. Cover 45 can now be removed from the location of casing 46 and manipulated, as is desired.

If desired, tool 10 can include means for adjusting the location of the gripper teeth to accommodate different cover diameters. For example, tool 10 can include a mechanism to allow selective positioning of teeth 38 and 39 along arms 36 and 37, an arrangement for shortening or extending shaft 31, and so forth. Similar adjustments are possible for other elements such as in conjunction with rod 44, teeth 17 and 18, etc.

Although the foregoing describes the exemplary preferred embodiments in relatively specific detail, those having normal skill in the art will recognize various changes, modifications, additions and applications other than those specifically mentioned herein without departing from the spirit of the invention.

What is claimed is:

1. Apparatus for facilitating the handling of a generally flat, heavy cover which has a relatively narrow edge around the perimeter thereof to fit into a recessed shoulder at the opening of a casing, comprising;

an elongated handle having a pair of spaced prong means extending from one end and in the same general direction as the length of said handle for engaging the cover perimeter edge at spaced contact points, each said prong means having a cam surface facing the casing opening for maintaining mechanical advantage for said elongated handle during rotation thereof until the cover is lifted from the casing shoulder, swing arm means having one end gripper means for engaging the cover edge including a tooth having a surface for engaging the cover perimeter edge, with said tooth surface sloping toward the bottom edge of the cover, whereby said tooth surface maintains contact below the upper surface of the cover in response to rotation of said elongated handle, and means pivotally attaching the other end of said swing arm means to said handle in proximity to said pair of prong means, said swing arm means having a length so that said gripper means tooth is adapted to enter between the cover edge and the casing on one side of the cover when said pair of prong means is inserted into the space between the cover edge and the casing on the opposite side of the cover, and ground engaging means secured to said handle in a position above the ground when said pair of prong means is inserted into the space between the cover edge and the casing, but for subsequently contacting the ground in response to rotation of said handle in a direction away from the cover, whereby placement of said pair of prong means and said gripper means tooth into engagement with respective edges of the cover, and rotation of said elongated handle in a direction away from the cover until said ground engaging means contacts the ground, results in removal of the cover from the casing in a secure and controlled manner.

2. Apparatus in accordance with claim 1 wherein said swing arm means has a pair of said gripper means for engaging the cover edge at spaced locations.

3. Apparatus in accordance with claim 1 wherein said gripper means tooth has a cover-engaging surface that is angled at about 70 degrees relative to the length of said swing arm means.

4. Apparatus in accordance with claim 1 wherein said ground engaging means includes means for rolling said apparatus away from the casing opening after rotation of said elongated handle.

5. Apparatus in accordance with claim 4 wherein said roller means includes a wheel and a generally vertically extending shaft for concurrently contacting the ground in response to rotation of said elongated handle, whereby the cover is pivotable away from the casing generally around said shaft.

6. Apparatus useful in handling a bulky, generally flat cover which has a pair of notches directed inwardly from its edge on one side of the cover, comprising:

an elongated handle means, a first cover engaging assembly including a pair of prongs and means positioning said prongs in spaced relation for entry in the pair of cover notches, a second cover engaging assembly attached to said handle means, and including means securable to the cover at a location remote from said prongs when said prongs engage the pair of cover notches, and means attached to said handle means in a position separated from the ground when said cover engaging assemblies initially contact the cover, but which are responsive to rotation of said handle means away from the cover for engaging the ground at two spaced points.

7. Apparatus in accordance with claim 6 wherein said ground engaging means includes at least one wheel for establishing roller capability for said apparatus and the cover secured thereto.

8. Apparatus in accordance with claim 7 wherein said ground engaging means includes a pin cooperative with said wheel for establishing a generally vertical center of rotation for said apparatus.

9. Apparatus in accordance with claim 6 wherein the cover has a hole therethrough, and said second cover engaging means including a rod for insertion into the cover hole, as said prongs contact the top surface of the cover in spatial relation, for locating said ground engaging means at a location for contacting the ground in the same manner as when said prongs are inserted into the pair of edge notches.

10. Apparatus in accordance with claim 6 wherein said cover includes a second pair of notches directed inwardly from its edge along the cover side that is generally opposite said one side, and wherein said second cover engaging assembly includes tooth means securable to the cover at the second pair of notches when said prongs engage the first named pair of cover notches.

11. Apparatus in accordance with claim 6 wherein said pair of prongs include cam surfaces located adjacent the casing with said cam surfaces constructed and arranged for engagement with the casing during initial rotation of said handle means, so that said apparatus continues to pivot about said cam surfaces until such time as the cover has been lifted from the casing, whereupon said ground enaging means become operative.

* * * * *

UNITED STATES PATENT AND TRADEMARK OFFICE

CERTIFICATE OF CORRECTION

PATENT NO. : 4,838,521

DATED : June 13, 1989

INVENTOR(S) : GERALD LEE MOISAN

It is certified that error appears in the above-identified patent and that said Letters Patent is hereby corrected as shown below:

Column 1, line 15, "siuch" should be --such--.

Column 2, line 25, "ifit" should be --fit--.

Column 2, line 62, "seperated" should be --separated--.

Column 4, line 42, "use" should be --user--.

Column 5, line 52, "the" (1st occurence) should be --that--.

Claim 5, line 2 "roller" should be --rolling--.

Claim 7, line 3, "roller" should be --rolling--.

Signed and Sealed this

Fifteenth Day of May, 1990

*Attest:*

HARRY F. MANBECK, JR.

*Attesting Officer*

*Commissioner of Patents and Trademarks*